US007611449B2

(12) United States Patent
Kim

(10) Patent No.: US 7,611,449 B2
(45) Date of Patent: Nov. 3, 2009

(54) RECOIL SHOCK ABSORBER

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 77 days.

(21) Appl. No.: 11/830,247

(22) Filed: Jul. 30, 2007

(65) Prior Publication Data

US 2009/0036279 A1 Feb. 5, 2009

(51) Int. Cl.
*A63B 21/22* (2006.01)
*A63B 15/00* (2006.01)
*A63B 57/00* (2006.01)
*A63B 53/16* (2006.01)

(52) U.S. Cl. ..... 482/110; 482/109; 473/219; 473/256

(58) Field of Classification Search ..... 482/109, 482/110, 128; 473/231, 256, 297, 318, 457, 473/520, 219, 226
See application file for complete search history.

(56) References Cited

U.S. PATENT DOCUMENTS 3,572,706 A * 3/1971 Schroder ..... 473/234
4,244,602 A * 1/1981 Allsop et al. ..... 280/821
4,274,631 A * 6/1981 Hayazaki ..... 473/457
4,317,567 A 3/1982 Blake
4,541,631 A * 9/1985 Sasse ..... 473/297
4,600,190 A 7/1986 Berokoff
4,614,343 A * 9/1986 Radway ..... 473/234
4,671,508 A 6/1987 Tetreault
4,809,975 A * 3/1989 Lee ..... 482/110
4,951,948 A * 8/1990 Peng ..... 473/520
4,967,596 A * 11/1990 Rilling et al. ..... 73/492
4,969,921 A * 11/1990 Silvera ..... 473/234
4,993,708 A * 2/1991 Prossor et al. ..... 473/417
5,577,966 A 11/1996 Duran
5,607,362 A * 3/1997 Haber et al. ..... 473/231
5,769,734 A 6/1998 Qualey, Sr.
5,842,933 A * 12/1998 Lewis ..... 473/300
6,461,163 B1 10/2002 Gallagher et al.
6,955,610 B1 10/2005 Czaja et al.
7,115,042 B2 10/2006 Gulan et al.
7,147,580 B2 * 12/2006 Nutter et al. ..... 473/457
7,226,365 B2 * 6/2007 Qualizza ..... 473/318
7,252,597 B2 * 8/2007 Li et al. ..... 473/318
2005/0153797 A1 7/2005 Nutter et al.
2005/0192112 A1 9/2005 Kim
2007/0123399 A1 5/2007 Kim

* cited by examiner

*Primary Examiner*—Loan H Thanh
*Assistant Examiner*—Allana Lewin
(74) *Attorney, Agent, or Firm*—Brown & Michaels, PC

(57) ABSTRACT

A golf exerciser in the form of a swingable tube containing a movable mass supported by an extension spring is provided with a shock absorber cooperating with a proximal end mount for the spring. This absorbs recoil movement of the mass, the spring, the connector, and reduces recoil impact shock that otherwise could be felt by the hands of the person exercising.

11 Claims, 3 Drawing Sheets

RECOIL SHOCK ABSORBER

TECHNICAL FIELD

A golf exerciser formed as a tube containing an extension spring and a weight so that when the tube is swung in a simulated golf swing the weight travels down the tube against the spring resistance.

BACKGROUND

The golf exercise that this invention improves upon, is described in my co-pending application Ser. No. 11/564,055, entitled Golf Swing Exerciser, the disclosure of which is incorporated herein by reference.

SUMMARY

I have discovered that stopping a simulated golf swing using my exerciser after passing a hitting region can cause a significant recoil. The weight that was moved by centrifugal force toward a distal end of the exercising tube becomes free to move toward the proximal end of the tube under the force of the extension of a spring connected to the weight. This can draw the weight, the extension spring, and a spring connector rapidly toward the proximal or handle end of the tube where these components can bang against an end stop. This can transmit a jarring effect to the hands of the person exercising, and it also hammers at the end stop and tends to break components.

The solution proposed by this invention is a spring mount supported to be movable over a limited distance toward and away from an end stop, and a resilient shock absorber mounted between the spring connector and the end stop to serve as a recoil shock absorber. This improvement eliminates a jarring impact to the hands of the person exercising, and contributes to a smooth and satisfying movement of the exercising tube. The result, as experienced by a person exercising, is a comfortable and controlled motion enhancing product durability.

DRAWINGS

DETAILED DESCRIPTION

Figure 1:
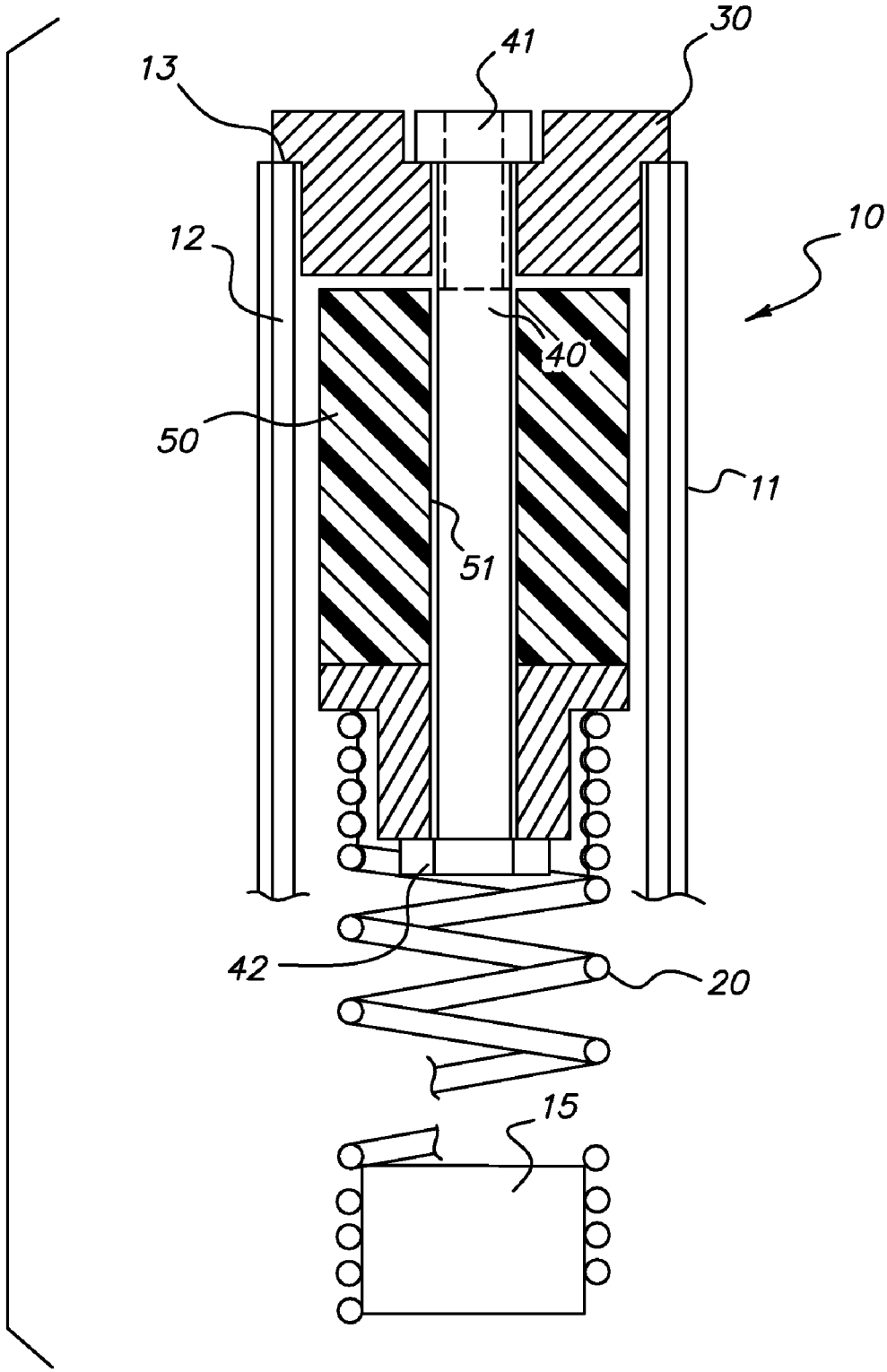
FIG. 1 is a partially schematic and partially cross-sectioned fragmentary view of a preferred embodiment of a recoil shock absorber according to the invention.

My discovery of the need for a recoil shock absorber in my exercising device, such as more fully disclosed in my co-pending U.S. patent application Ser. No. 11/564,055 entitled Golf Swing Exerciser occurred during instructional work with golfers using the exercising device. To achieve effective exercise, it is necessary to swing the exercising tube 10 with a sufficient velocity to drive a mass 15 to a distal end of the tube. When mass 15 reaches the distal tube end, it transfers its outward velocity to tube 10, which gives the person swinging the tube a force to resist and helps improve a golfer's swing.

This requirement results in mass 15 extending spring 20 as far as possible as exerciser 10 swings through a hitting region. As the swing is thereafter stopped, spring 20 pulls mass 15 back toward the proximal end of exerciser 10 in the region of hand grip 11. Spring 20 can then retract to a coil-to-coil configuration that transmits the velocity of mass 15, spring 20, and spring connector 25 to a proximal end stop 30 in the region of hand grip 11. This can deliver an unpleasant impact shock to the hands of the person exercising and can break parts of the exerciser when repeated.

The remedy for this problem is a recoil shock absorber as shown in the drawings. This requires a spring connector 25 that is mounted for limited movement toward and away from end stop 30 to accommodate a recoil movement. It also requires a resilient recoil shock absorber arranged between end stop 30 and connector 25 to bring proximal movement of connector 25 to a gradually resisted stop that spreads out and therefore diminishes the impact of the recoil movement of spring mount 25 and mass 15.

The generally preferred way of arranging such a shock absorber is shown in FIG. 1. A nut 41 secures a bolt 40 to end stop 30 so that a bolt head 42 can limit the movement of spring connector or mount 25 away from end stop 30. Between spring mount 25 and stop 30 is a resilient shock absorbing element 50 that preferably has a center bore 51 allowing it to be positioned on and held in place by bolt 40. The complete arrangement is confined within tube 12, which also holds extension spring 20 and mass 15. For simplicity of illustration, the drawings eliminate details involving the length of tube 12 toward its distal end. Information on this is contained in my co-pending patent application.

Figure 2:
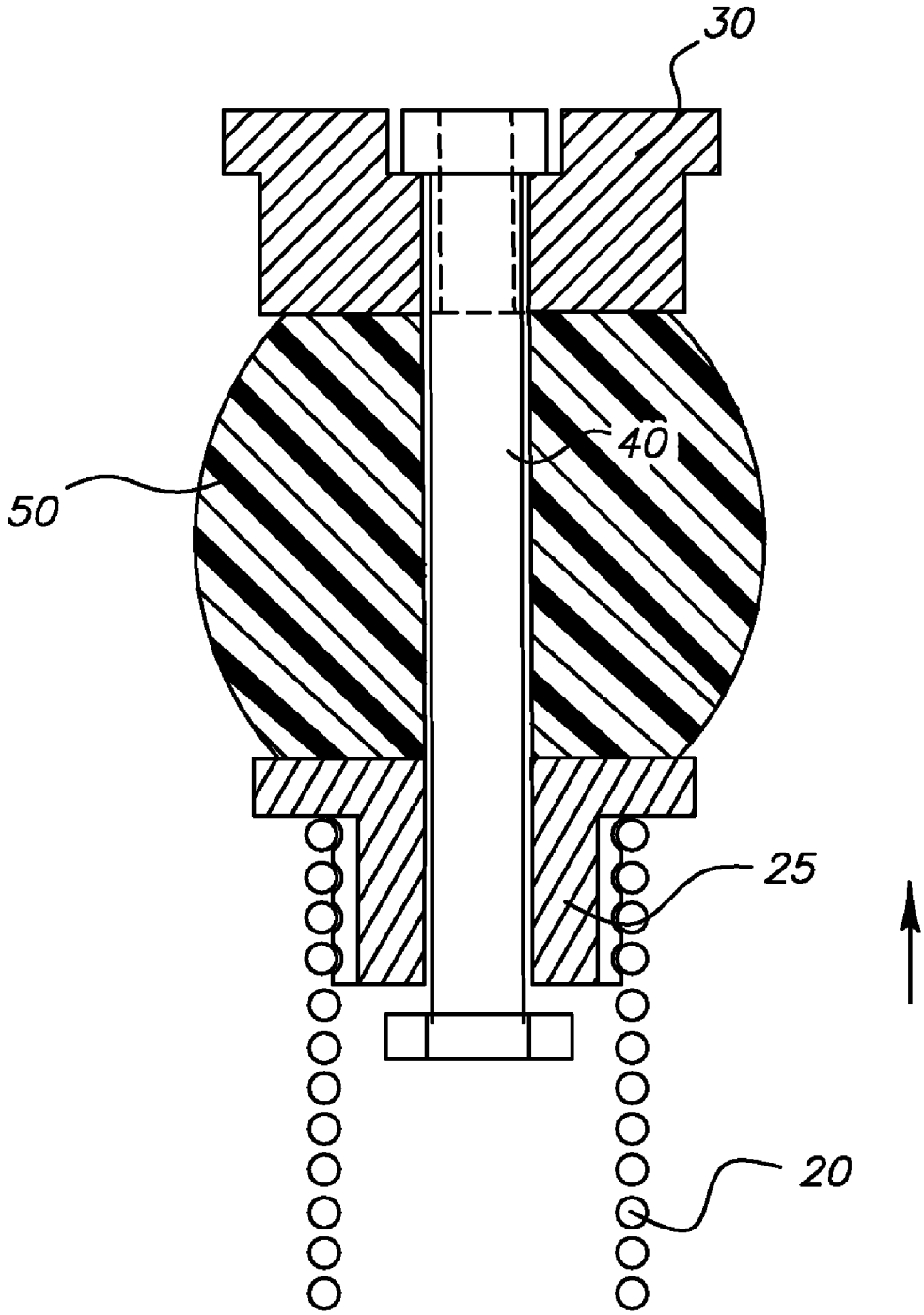
FIG. 2 is a fragmentary view, similar to the view of FIG. 1, showing the shock absorber in action upon a recoil.

Shock absorber 50 is preferably an elastomeric device that can be deformed, as shown in FIG. 2 when spring mount 25 recoils toward end stop 30. Recoil element 50, which is movably trapped between spring mount 25 and stop 30 elastically and radially expands as it absorbs the recoil motion of spring mount 25.

Bolt 40 provides a lost motion connection for spring mount 25, which can rest against bolt head 42 during resistance to centrifugal force applied during a simulated golf swing, and can then move toward end stop 30 during a recoil. When this occurs, spring 20 can retract in a coil-to-coil configuration shown in FIG. 2. A few terminal coils of spring 20 are preferably threaded onto spring mount 25 to form a connection between spring 20 and mount 25. End stop 30 is preferably well secured within the proximal end region of tube 12, and this can be done with set screws or pins, adhesive, crimping, etc.

Figure 3:
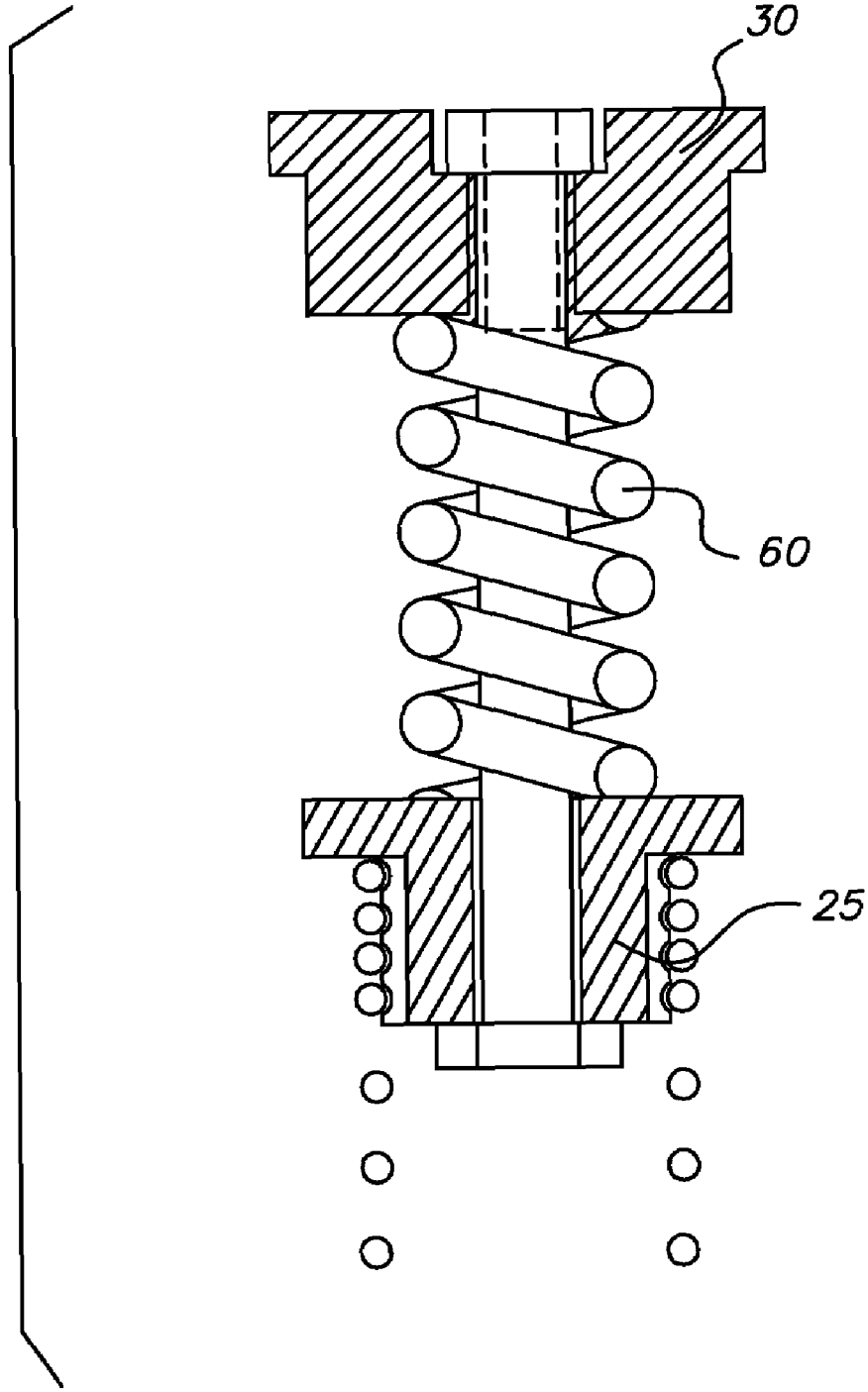
FIG. 3 is a fragmentary view similar to the view of FIG. 1 showing a spring form of recoil shock absorber.

The FIG. 3 embodiment substitutes a compression spring 60 for elastomeric shock absorber 50. Spring 60 and elastomeric element 50 have a similar effect by absorbing the recoil energy of mount 25, spring 20, and mass 15 moving toward a proximal end 13 of tube 12. They each slow down such a recoil movement as they absorb recoil energy over a brief time interval, which reduces any impact shock that can be felt by the hands of a person exercising.

The result makes exerciser 10 more comfortable to use and more durable in accommodating countless numbers of exercising swings and accompanying recoils. From the point of view of the person exercising, the recoil shock absorber makes exerciser 10 feel smoother and more comfortable to make the exercise both agreeable and effective in improving a golfer's swing.

What is claimed is:

1. In a golf swing exerciser that moves a weight against a resistance of an extension spring during a simulated golf swing, an improvement comprising:

the weight being fixed to a distal end of the extension spring;

a connector fixed to a proximal end of the extension spring to hold the proximal end against an extension force from movement of the weight;

a proximal end stop spaced from the connector;

a mount supported by the end stop and extending to the connector;

the mount allowing the connector and the proximal end of the extension spring to move in a recoil motion toward the end stop;

the mount limiting motion of the connector and the proximal end of the extension spring away from the end stop in response to the extension force; and a resilient shock absorber arranged between the connector and the stop to cushion the recoil motion.

2. The golf swing exerciser of claim 1 wherein the fixing of the connector to the extension spring is by terminal convolutions of the extension spring being threaded to the connector.

3. The golf swing exerciser of claim 1 wherein the mount is a bolt allowing the connector to slide toward and away from the end stop.

4. An exercising device used in a simulated golf swing, the device including an extension spring mounted to resist movement of a weight toward a distal end of the device during the golf swing, the device comprising:

the weight being securely attached to a distal end of the extension spring;

a spring connector securely attached to a proximal end of the extension spring;

a proximal end stop spaced from the connector on a proximal side of the connector opposite the spring;

a mount supporting the spring connector relative to the proximal end stop to limit motion of the spring connector and the proximal end of the spring away from the proximal end stop as the weight moves;

a resilient shock absorber disposed between the proximal end stop and the spring connector so that the shock absorber cushions a recoil motion of the spring and the connector toward the proximal end stop; and the mount allows movement of the spring connector toward the proximal end stop.

5. The exercising device of claim 4 wherein the mount is a bolt extending from the proximal end stop, and the connector is slidably mounted on the bolt.

6. The exercising device of claim 4 wherein the shock absorber is supported by the mount.

7. The exercising device of claim 6 wherein the mount is a bolt and the bolt extends through the shock absorber.

8. A golf exerciser that is moved in a simulated golf swing and includes a handle affording a grip to swing the exerciser, and an end stop in a proximal region of the handle, an extension spring mounted to extend toward a distal end of the exerciser, a weight attached to a distal end of the spring, and the spring and weight being arranged so that the weight extends the spring to move toward the distal end of the exerciser when the exerciser is moved in a simulated golf swing, the exerciser comprising:

a connector attached to a proximal end of the spring to resist extending of the spring;

the connector being spaced from the end stop;

a lost motion mount extending across the space from the end stop to the connector;

the mount supporting the connector to allow and to limit movement of the connector and the proximal end of the spring away from the end stop as the weight moves;

the mount also allowing the connector and the proximal end of the spring to move toward the end stop in a recoil movement; and a resilient recoil shock absorber supported by the mount and arranged in the space between the end stop and the connector so that the shock absorber cushions the recoil movement of the spring connector and the proximal end of the spring toward the end stop.

9. The golf exerciser of claim 8 wherein the mount is a bolt extending from the end stop, and the spring connector is slidably mounted on the bolt.

10. The golf exerciser of claim 9 wherein the bolt extends through the shock absorber.

11. The golf exerciser of claim 8 wherein the spring connector threadably engages the insides of terminal coils of the proximal end of the spring.

* * * * *